US005651402A

United States Patent [19]

McCaul

[11] Patent Number: 5,651,402

[45] Date of Patent: Jul. 29, 1997

[54] AUTOMATED BALLOON INFLATION DEVICE

[75] Inventor: Michael F. McCaul, Overland Park, Kans.

[73] Assignee: David C. Nelson of Premium Balloon Accessories, Sharon Center, Ohio

[21] Appl. No.: 602,465

[22] Filed: Feb. 16, 1996

Related U.S. Application Data

[63] Continuation-in-part of Ser. No. 382,449, Feb. 2, 1995.

[51] Int. Cl.[6] ..... B65B 31/00

[52] U.S. Cl. ..... 141/314; 141/51; 141/97; 141/114; 141/313; 53/79; 446/220; 194/212; 194/214

[58] Field of Search ..... 141/1, 4, 10, 46, 141/51, 67, 97, 114, 173, 197, 313–317; 53/79, 84, 88, 403, 385.1, 459, 469, 570; 137/223, 227, 231; 446/220, 222; 70/402, 405, 407, 456 R; 194/212, 214

[56] References Cited

U.S. PATENT DOCUMENTS 3,561,579 2/1971 Allison ..... 194/219

4,302,106 11/1981 Taylor ..... 356/240

*Primary Examiner*—J. Casimer Jacyna

*Attorney, Agent, or Firm*—Renner, Kenner, Greive, Bobak, Taylor & Weber

[57] ABSTRACT

An automated balloon inflation device which has a supply of pressurized gas, a nozzle for receiving a balloon, and an actuator for sequentially closing a clamp on the balloon and the nozzle and subsequently supplying the pressurized gas to the balloon for the inflation thereof. Furthermore, a key-weight device may be employed for the dual purpose of controlling the supply of pressurized gas to the nozzle and to prevent the inadvertent loss of an inflated balloon which is secured to the key-weight. Additionally, the automated balloon inflation device is constructed so that any consumer may inflate a balloon with pressurized gas. In another embodiment, the automated balloon inflation device employs a connection block with a series of conduits therein to interconnect the pressurized gas supply with the clamping mechanism and the nozzle. This embodiment employs a clamping mechanism which uses a piston attached to a gear wherein the gears rotate clamping jaws onto the nozzle. The present embodiment also provides a door trigger mechanism which only allows gas to flow to the nozzle and clamping mechanism when a door to the device is closed.

17 Claims, 6 Drawing Sheets

AUTOMATED BALLOON INFLATION DEVICE

CROSS-REFERENCE TO RELATED APPLICATION

This is a continuation-in-part of application Ser. No. 08/382,449 filed Feb. 2, 1995, and still pending for an automated balloon inflation device.

TECHNICAL FIELD

The invention herein resides generally in the art of automated balloon inflation devices. More particularly, the present invention relates to an automated balloon inflation device in a self-contained enclosure that is safe for consumers to use. Specifically, the present invention relates to a self-contained automated balloon inflation device that is actuated by employing a key-weight device which is preferably secured to the balloon by a ribbon.

Background Art

Balloons are known to be used in many different ways. Hot air balloons are employed as recreational devices and for observing ground based activities from a relatively stationary position in the sky. Weather balloons are employed to track atmospheric conditions such as wind speed, barometric pressure and air temperature. One very popular use of balloons is to entertain children at birthday parties, amusement parks and other such events. Typically, balloons are made of latex rubber, non-latex synthetic material or other flexible semi-rigid materials and are usually filled with air or a lighter than air gas such as helium. Recently, the use of helium in non-latex synthetic material balloons with a self sealing valve has become quite popular. Moreover, balloons can be imprinted with various colorful designs to delight children and adults of all ages.

Unfortunately, the use of helium inflated balloons is limited because of the inherent dangers in using a dangerous pressurized gas to inflate the balloons. Although helium is a non-toxic gas, inhaled helium is an asphyxiant that replaces oxygen in a person's system causing suffocation. Moreover, helium tanks are pressurized to very high levels. As such, anyone who accidentally or otherwise inhales helium directly from a pressurized tank risks serious injury to their lungs. As a result, unattended helium tanks without proper safeguards pose a serious safety risk.

Although several automated balloon inflation devices are available there are very few readily usable by the average consumer. Some of these balloon inflating devices require the insertion of the balloon onto a nozzle, which is in communication with the pressurized gas supply, without the benefit of a clamping device to hold the balloon. This lack of a clamping device may allow the dangerous pressurized gas to be misdirected away from the balloon. As such, the balloon may be under or over inflated. Another detriment to using currently available balloon inflation devices is that the consumer still has direct access to the source of pressurized gas.

There is also an inherent danger in the use of metallic non-latex synthetic balloons filled with a lighter than air gas. It is well known that metallic non-latex synthetic balloons are conductive and that if they come in contact with electrical power lines, the power lines may be shorted out causing a power failure in the immediate area. Another danger of balloons filled with a lighter than air gas is that after the gas escapes, the balloon may settle anywhere in the environment. As a result, the balloon may come in contact with wildlife and cause unnecessary injury or, at the very least, add to undesirable litter. In fact, some states are so concerned with these dangers that legislation has been enacted to require the use of balloon weights to prevent the balloons from aimlessly floating away.

Based upon the foregoing, it is evident that there is a need for an automated balloon inflation device in a self contained enclosure that can be safely used by the average consumer or other untrained store personnel. Furthermore, there is also a need for an automated balloon inflation device which ensures that a balloon weight is attached to the lighter than air filled balloon so that the balloon complies with the necessary state laws. Moreover, there is also a need for an automated balloon inflation device where a connection block facilitates the interconnections between the pressurized gas supply and the clamping and nozzle mechanisms to increase the reliability of the automated balloon inflation device.

DISCLOSURE OF THE INVENTION

In light of the foregoing, it is a first aspect of the present invention to provide an automated balloon inflation device.

Another aspect of the present invention is to provide an automated balloon inflation device in a self-contained enclosure.

Still a further aspect of the present invention is to provide an automated balloon inflation device accessible for use by a consumer.

An additional aspect of the present invention is to provide an automated balloon inflation device for a user, wherein the consumer does not have access to a pressurized gas supply nor any internal components of the device.

Yet an additional aspect of the present invention is to provide an automated balloon inflation device that requires the insertion of a retrievable key-weight before the device can be operated.

A further aspect of the present invention is to provide an automated balloon inflation device which has a door to prevent the consumer from being exposed to any pressurized gas during the balloon inflation process.

Another aspect of the present invention is to provide an automated balloon inflation device such that when the door to the device is closed, a clamping device is activated to hold the balloon onto a nozzle during the inflation process.

Yet a further aspect of the present invention is to provide a nozzle that is flexibly movable with respect to a clamping device Still a further aspect of the present invention is to provide an automated balloon inflation device wherein a pressurized gas supply to inflate the balloon to a desired pressure is only activated upon complete closure of the door.

Yet a further aspect of the present invention is to provide an automated balloon inflation device that is safer than any previously known self-service balloon inflation device.

Yet another aspect of the present invention is to provide a single connection block that interconnects the operational components of the inflation device.

Still another aspect of the present invention, as set forth above, is to provide a gas-actuated gear clamping mechanism.

The foregoing and other aspects of the invention which shall become apparent as the detailed description proceeds, are achieved by an automated balloon inflation device for inflating balloons, comprising: a supply of pressurized gas;

a nozzle for receiving a balloon; means for clamping the balloon to the nozzle; and a connection block for transferring the supply of pressurized gas to actuate the clamping device and to the nozzle for inflating the balloon.

The present invention also provides an automated balloon inflation device for inflating balloons, comprising: a connection block which has a plurality of conduits therethrough; a key-weight valve connected to one of the plurality of conduits; a door valve connected to one of the plurality of conduits; a nozzle connected to one of the plurality of conduits; a clamping mechanism connected to one of the plurality of conduits, the clamping mechanism closable upon a balloon received by the nozzle; and a supply of gas connected to one of the plurality of conduits, the supply of gas actuating the clamping mechanism and inflating the balloon when the key-weight valve and the door valve are operatively engaged, the supply of gas flowing through the plurality of conduits.

The present invention also provides an automated balloon inflation device for inflating balloons, comprising: a housing having a cabinet portion and a hood portion separated by a counter top, the hood portion having a key-weight opening; a door hingedly connected to said hood portion; a connection block mounted to the counter top, the connection block having a plurality of conduits therethrough; a supply of gas received within the cabinet portion and connected to one of the plurality of conduits; a clamping mechanism mounted to the connection block and connected to one of the plurality of conduits; a nozzle extending from the connection block and connected to one of the plurality of conduits; a key-weight receptacle connected to the connection block and having a key-weight valve, the key-weight receptacle aligned with the key-weight opening; a door trigger carried in the cabinet portion; a door valve mounted to the connection block and operatively engaged by the door trigger; and a door rod mounted to the door and passing through the counter top and engaging the door trigger when the door is in a closed position; the key-weight receptacle receiving a key-weight to operatively engage the key-weight valve to allow the supply of gas to flow via the plurality of conduits through the key-weight valve, the door valve, the clamping mechanism to secure a balloon to the nozzle and to the nozzle to inflate the balloon.

BEST MODE FOR CARRYING OUT THE INVENTION

Figure 1:
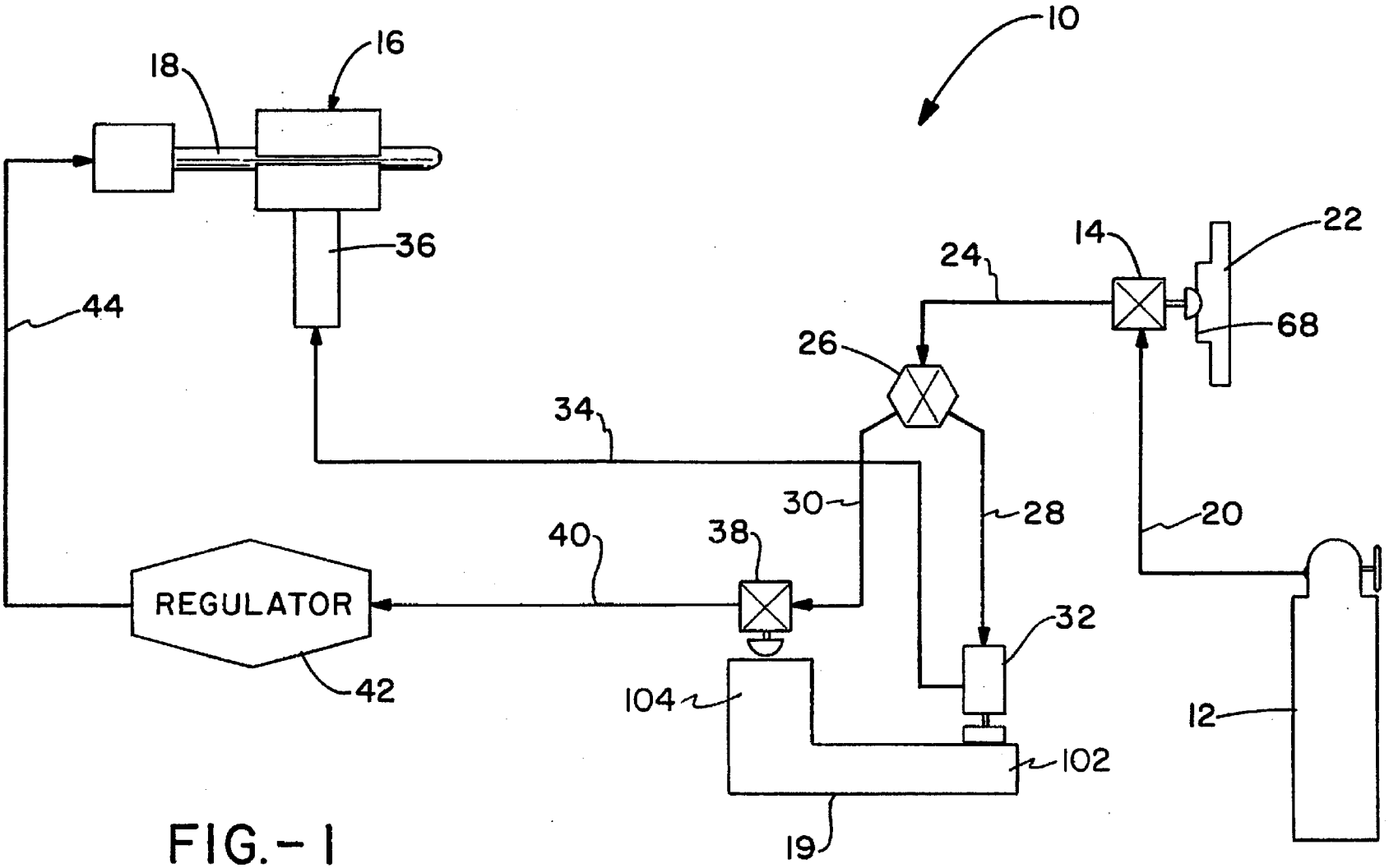
FIG. 1 is a schematic diagram illustrating the operation of an automated balloon inflation device.

Referring now to the drawings and more particularly to FIG. 1, it can be seen that an automated balloon inflation device according to the present invention is designated generally by the numeral 10. Generally, the automated balloon inflation device 10 includes a supply of pressurized gas 12, a key-weight valve 14 communicative with the pressurized gas supply 12, a clamp 16 operatively controlled by the pressurized gas supply 12, a nozzle 18 communicative with the pressurized gas supply 12, and an actuator 19 which provides the pressurized gas 12 to at least the nozzle 18. As will be described in detail hereinbelow, the operator of the device 10 inserts a balloon onto the nozzle 18 and engages the actuator 19 whereupon the clamp 16 secures the balloon to the nozzle 18 so as to allow the source of pressurized gas 12 to inflate the balloon. The drawings are exemplary of a balloon inflation device used with balloons made of metallic-nylon-polyester resinous material frequently sold under the trademark "Mylar," which is owned by the DuPont Corporation. The present invention could also be practiced with any other latex or non-latex synthetic balloon material. Furthermore, although the supply of pressurized gas in the preferred embodiment is helium, the present invention could also be practiced with any type of pressurized gas.

In particular, the pressurized gas supply 12 is connected to a feed line 20 which is operative with the key-weight valve 14. The operation of the key-weight valve 14 is controlled by the insertion of a key-weight into a key-weight slot 22. The key-weight valve 14 is connected to a feed line 24 which is communicative with a splitter valve 26. The splitter valve 26 has two output ports, one of which is connected to a feed line 28 and the other of which is connected to a feed line 30. The opposite end of feed line 28 is connected to a clamp valve 32 which is connected to a feed line 34. The feed line 34 is connected to an air cylinder 36 which operatively controls the position of the clamp 16. Those skilled in the art will appreciate that the air cylinder 36 is operable with any type of pressurized gas such as helium. The opposite end of feed line 30 is operatively connected to an inflation valve 38. The inflation valve 38 is connected to a feed line 40 which supplies pressurized gas 12 to a pressure regulator 42. The pressure regulator 42 is connected to a feed line 44 which is communicative with the nozzle 18.

Figure 2:
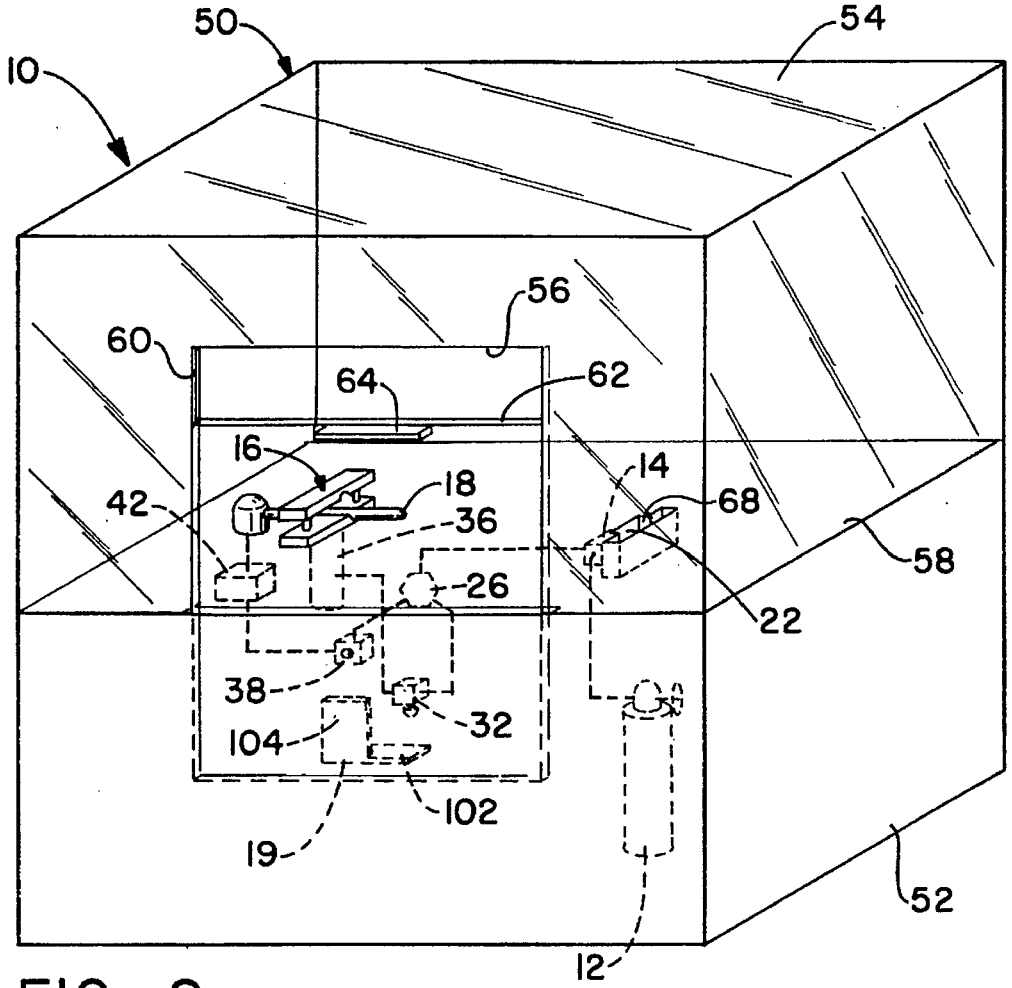
FIG. 2 is a perspective view of a housing which contains the automated balloon inflation device.

Referring now to FIG. 2, it can be seen that the automated balloon inflation device 10 is contained within a housing designated generally by the numeral 50. The housing 50 has a cabinet portion 52 which stores the pressurized gas supply 12, the feed lines 20, 24, 28, 30, 34, 40 and 44, the key-weight valve 14, the splitter valve 26, the clamp valve 32, the air cylinder 36 and the pressure regulator 42. The housing 50 also has a hood portion 54 which has a door opening 56. A base 58 separates the cabinet portion 52 from the hood portion 54. It will be appreciated that the clamp 16 is securably attached to the base 58 and is accessible through the hood portion 54 via the door opening 56. The base 58 has a bore 58*a* through which the nozzle 18 is slidably retained therein. It will further be appreciated that the air cylinder 36 is received within the base 58 so that the air cylinder 36 is cooperative with the clamp 16. The door opening 56 has a plurality of door channels 60 for receiving an access door 62. The access door 62 is slidably moved from an open position to a closed position by exerting a force on a door handle 64. It will also be appreciated that the base 58 has a key-weight slot 22 with a key-weight channel 68. Those skilled in the art will appreciate that the key-weight valve 14 is operatively disposed within the key-weight channel 68.

Figure 3:
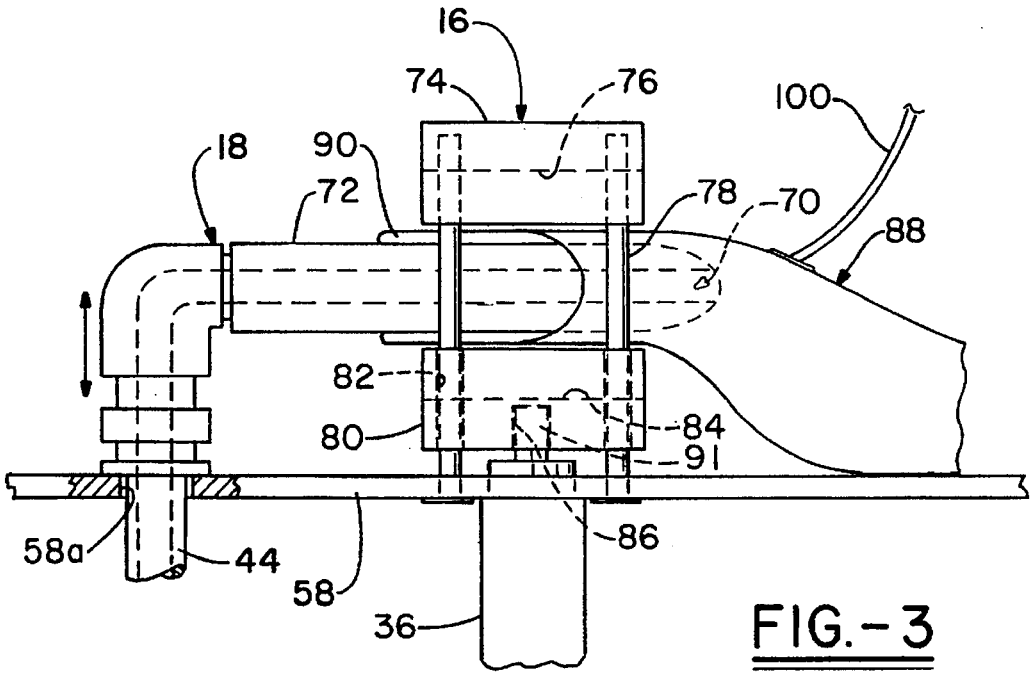
FIG. 3 is an elevational view in partial cross-section, showing the nozzle with a balloon received thereon and a clamping device shown in the open position.

Referring now to FIG. 3, a detailed view of the clamp 16 and the nozzle 18 is shown. In particular, it can be seen that the nozzle 18 is mounted to the base 58 and connected to the feed line 44. The nozzle 18 includes a tubular portion 72 which has a bore or orifice 70. The nozzle 18 is positioned such that it is in a working relationship with the clamp 16.

Figure 4:
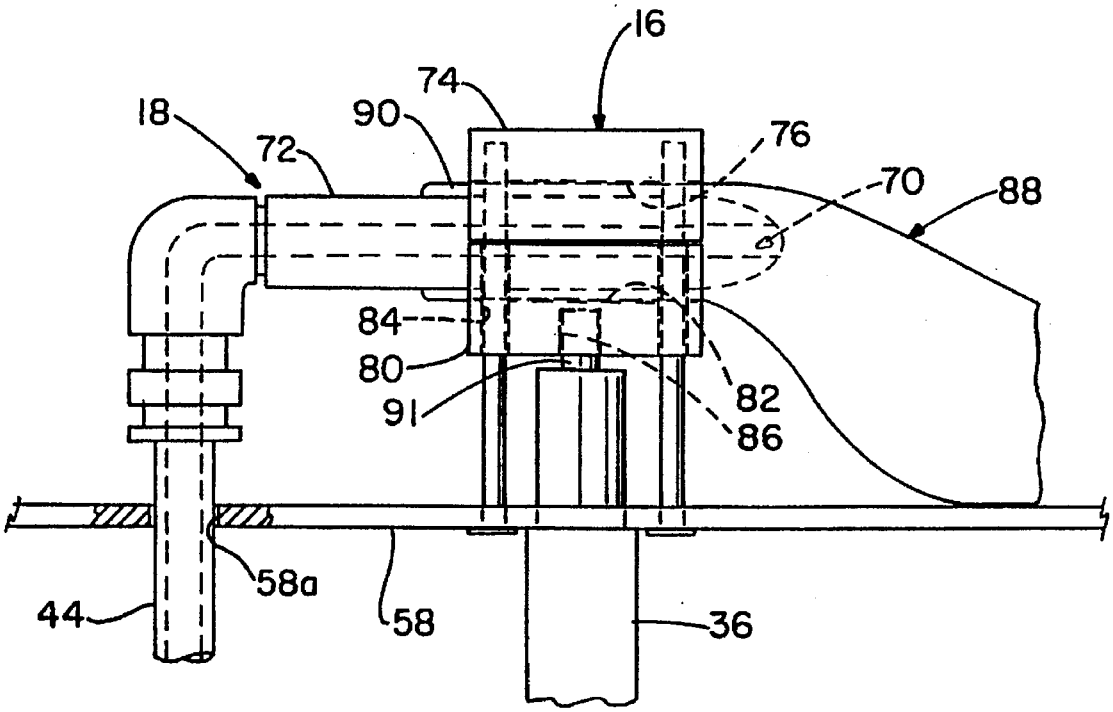
FIG. 4 is an elevational view similar to FIG. 3 illustrating the clamping device in a closed position upon the balloon and the nozzle.

The clamp 16, shown in the open position, has an upper block 74 with a nozzle receiving portion or channel 76 which conforms to the shape of the nozzle tubular portion 72. A plurality of guide posts 78 are received within the upper block 74 and also within a movable block 80. The movable block 80 has guide holes 82 which slidably receive the guide posts 78. The movable block 80 has a cylinder receiving portion 86 that is operative with the air cylinder 36 which is communicative to feed line 28. The movable block 80 also has a nozzle receiving portion 84 which conforms to the shape of the tubular portion 72. Those skilled in the art will appreciate that the tubular portion 72 receives a balloon 88 there on. The balloon 88 has a neck 90 which snugly fits on to the tubular portion 72. As seen in FIG. 4, when an air cylinder 36 receives a supply of pressurized gas 12 through the feed line 28, a cylinder piston 91 extending into the cylinder receiving portion 86 exerts an upward force on the movable block 80. As a result, the movable block 80 is slidably moved along the guide posts 78 to clamp or firmly secure the neck 90 of the balloon 88 between the movable block 80 and the upper block 74. The nozzle 18, which is slidably movable within the bore 58*a*, slides upward as the nozzle portion 84 engages the tubular portion 72 until the movable block 80 is stopped by the upper block 84. It will be appreciated that the nozzle receiving portions 76 and 84 securely conform around the neck 90 to prevent any inadvertent loss of pressurized gas 12 during the inflation process.

Figure 5:
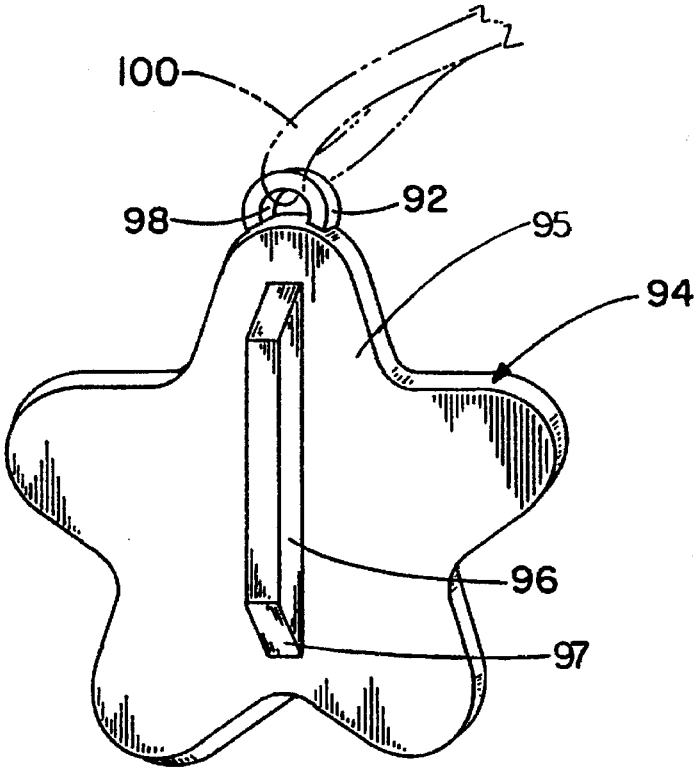
FIG. 5 is a perspective view of a key-weight device used to operate the automated balloon inflation device.

Referring now to FIG. 5, a key-weight, designated generally by the numeral 94, is shown. The key-weight 94 includes a body 95 which has a ridge 96 that extends outwardly therefrom and which is adapted to engage the key-weight valve 14. The ridge 96 has a ramp 97 at one or both ends thereof that is integral with the body 95. The body 95 also has a ring or other means 92 defining a ribbon hole 98 which receives a ribbon 100 therein. It will be appreciated that the opposite end of the ribbon 100 is secured to the neck 90 of the balloon 88. It will further be appreciated that the key-weight 94 is received within the key-weight slot 22 shown in FIG. 2. Furthermore, the key-weight ridge 96 is received within the key-weight channel 68. As such, the key-weight 94 enables an automated balloon inflation device for operation.

Referring again to FIG. 2, it can be seen that the access door 62 carries thereon the actuator 19 which has a clamp activator 102 and a nozzle activator 104. Those skilled in the art will appreciate that as the access door 62 is closed, the clamp activator 102 comes in contact with the clamp valve 32 while a short time later the nozzle activator 104 comes in contact with the inflation valve 38. In the preferred embodiment, the clamp valve 32 is a three-way roller valve so that as the access door 62 is opened and closed, the clamp valve 32 is gradually opened and closed. By employing a three-way roller valve as clamp valve 32, any gas trapped within the feed line 34 is vented to atmosphere.

In operation, a consumer will purchase an uninflated balloon 88 which is attached to a ribbon 100 that has at its opposite end a key-weight 94. The consumer will insert the key-weight 94 into the key-weight slot 22 so as to activate the key-weight valve 14. The body 95, which has an outwardly extending ridge 96 that is received by the key-weight channel 68, operatively engages (opens and closes) the key-weight valve 14 which is communicative with the pressurized gas supply 12. The ramp 97, which provides a transitional slope between the body 95 and ridge 96, functions to gradually engage the key-weight valve 14. In other words, the ramp 97 makes first contact with the key-weight valve 14 as it is inserted into the key-weight channel 68 and the ridge 96 holds the key-weight valve 14 in an enabling position once it is fully inserted. By engaging the key-weight valve 14 with the ridge 96, the pressurized gas flows from the supply 12 through the feed lines 20 and 24 to the splitter valve 26. Meanwhile, the consumer will insert the balloon neck 90 onto the tubular portion 72 of the nozzle 18. In the preferred embodiment, the balloon 88 has a one-way valve which allows pressurized gas to enter, but not exit, the balloon. After the balloon has been disposed on the nozzle 18, the consumer spreads the balloon 88 out so that it inflates evenly.

Afterwards, the consumer slidably moves the access door 62 and the actuator 19 carried thereon into a closed position such that the clamp activator 102 engages the clamp valve 32 and the nozzle activator 104 engages the inflation valve 38. Those skilled in the art will appreciate that the gas 12 then flows from the feed line 28 through the clamp valve 32, through the feed line 34 to the air cylinder 36. At this time, the air cylinder 36 is actuated by the pressurized gas supply and causes the cylinder piston 91 contained therein to forcibly move the movable block 80, which slidably moves the nozzle 18, along the guide posts 78 into mating contact with the upper block 74 so as to clamp around the balloon neck 90 and the nozzle tubular portion 72. Subsequently, when the nozzle activator 104 engages the inflation valve 38, the pressurized gas 12 flows through the feed lines 30 and 40 to the pressure regulator 42. From the pressure regulator 42, the gas 12 flows through the feed line 44 then into the orifice 70 and into the balloon 88 for the inflation thereof. Those skilled in the art will appreciate that the pressure regulator 42 is set at a predetermined pressure such that the balloon secured to the nozzle 18 does not over inflate.

As best seen in FIG. 2, it is apparent that the clamp activator 102 and the nozzle activator 104 are carried on the access door 62 in a manner that allows sequential activation of the clamp 16 before pressurized gas 12 is supplied to the nozzle 18. This is done so that the pressurized gas 12 does not force the balloon 88 off of the nozzle 18 before the clamp 16 is engaged. This feature also prevents the inadvertent emission of pressurized gas 12 into the hood portion 54 of the housing 50.

After the balloon 88 has inflated to the preselected pressure as set by the pressure regulator 42, the consumer opens the access door 62 so as to disengage the clamp activator 102 from the clamp valve 32 and also to disengage the nozzle activator 104 from the inflation valve 38. As should be apparent from the above description, the pressurized gas 12 stops flowing to the nozzle 18 and subsequently the pressurized gas 12 stops flowing to the air cylinder 36 so as to release clamping pressure from the balloon neck 90 so that the clamp 16 and nozzle 18 return to their starting position. As the clamp valve 32 is opened, any gas within the feed line 34 is quickly released to atmosphere. Afterwards, the consumer reaches into the hood portion 54 through the door opening 56, removes the balloon 88 from the nozzle 18 and withdraws the key-weight 94 from the key-weight slot 22.

In the preferred embodiment, the hood portion 54 is constructed of an optically clear material such as glass or plastic so that the consumer can see the balloon 88 during the inflation process. This allows the consumer to quickly ascertain whether the balloon 88 is properly installed on the nozzle 18 and whether the clamp 16 has properly secured the balloon 88. If the balloon is not properly secured in the clamp 16, the consumer can open the access door 62 and reaffix the balloon 88 to the nozzle 18. It will also be appreciated that the cabinet portion 52 contains the necessary pressurized gas supply 12 and all of the inner workings of the automated balloon inflation device 10 so that they are not accessible to the consumer. The structure of device 10 greatly decreases the consumers access to the pressurized gas supply 12. In the preferred embodiment, the pressurized gas supply is helium, although any other lighter than air gas could be used.

It is apparent then from the above description of the operation of the automated balloon inflation device 10 that the problems associated with the previous balloon inflation devices have been overcome. In particular, the balloon inflation device 10 is convenient and safe to use by virtue of the fact that the pressurized gas supply and all of the inner workings are inaccessible to the consumer. Furthermore, by only allowing the inflation process to occur when the access door 62 has closed the hood portion 54, the consumer is prevented from inadvertently inhaling the pressurized gas. As such, the danger of the consumer becoming asphyxiated or of having their lungs injured is virtually eliminated.

Another advantage of the automated balloon inflation device 10 is the requirement that the key-weight 94 be inserted into the key-weight slot 22 before the operation of the device 10 can commence. This particular feature has several advantages. First, it ensures that a key-weight 94 is used with a balloon 88 that is going to be filled with a lighter than air gas. As such, the possibility of a helium filled metallic non-latex synthetic material balloon interfering with electrical power lines and the possibility of such a balloon harming the environment is greatly reduced. Furthermore, the key-weight 94 prevents the inflated balloon 88 from inadvertently floating away to the distress of the person holding the balloon. Another advantage of the automated balloon inflation device 10 is that the pressure regulator 42 prevents the balloon 88 from over inflating. This is accomplished even if the access door 62 remains closed for an extended period of time. Of course, an embodiment of this device could be operated without requiring the use of a key-weight 94.

Figure 6:
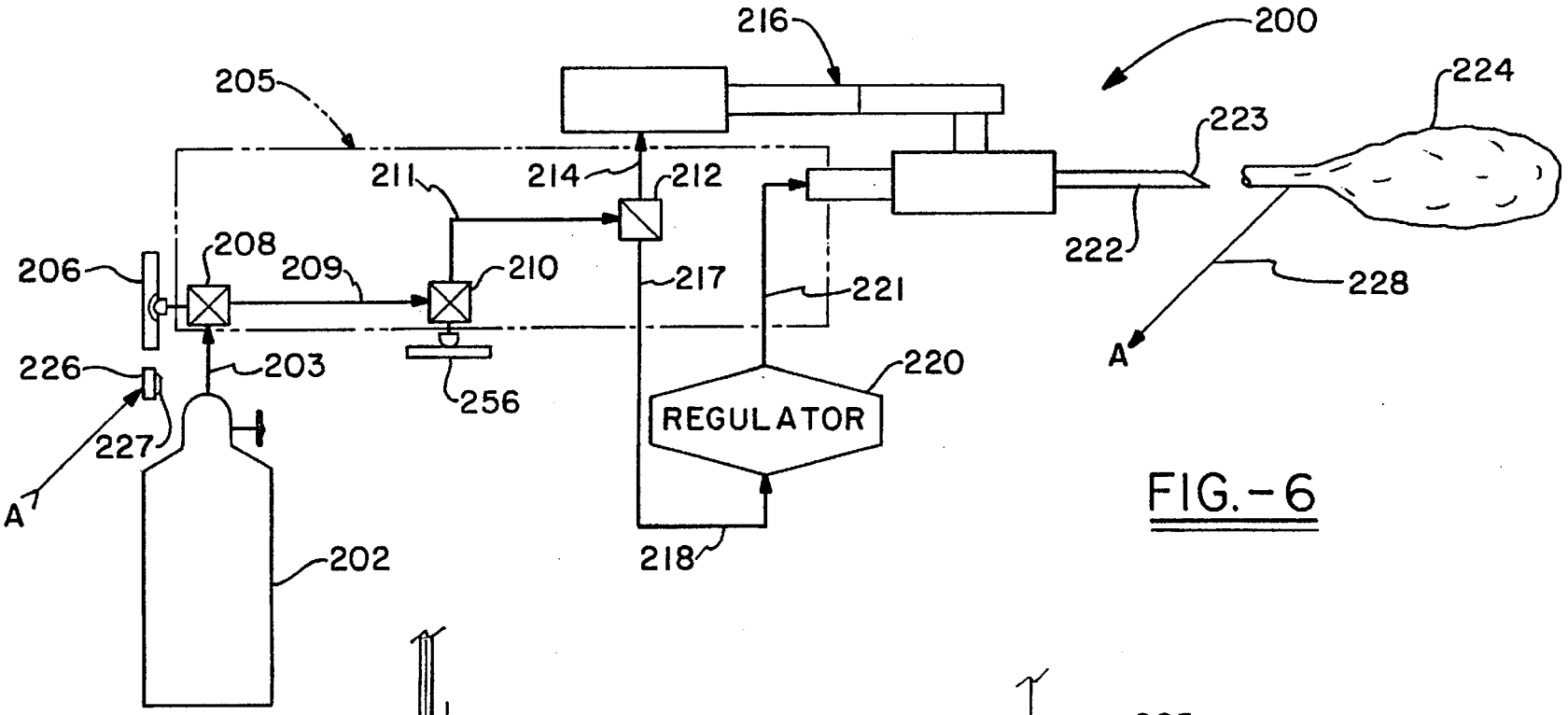
FIG. 6 is a schematic diagram illustrating the operation of an alternative embodiment of the automated balloon inflation device.

Referring now to FIG. 6, it can be seen that an alternative embodiment of the automated balloon inflation device according to the present invention is designated generally by the numeral 200. Although similar in operation to the previous embodiment, the automated balloon inflation device 200 presents several advantages not found therein. Generally, the device 200 includes a supply of pressurized gas 202 with an attached high pressure regulator. Typically, the pressurized gas supply 202 contains helium gas. The attached high pressure regulator reduces the pressure of the gas supply from about 2,400 psi to about 70 psi. A hose 203 interconnects the pressurized gas supply 202 to a connection block 205. In the preferred alternative embodiment, the connection block 205 is a solid piece of aluminum or other metal with drilled conduits or passageways for distributing the gas supply to various valves and other attachments to be discussed hereinbelow. Those skilled in the art will appreciate that the connection block could also be made of a polymeric material that is impervious to the gas employed in the pressurized gas supply 202.

Mounted to the connection block 205 is a key-weight receptacle 206 which has received therein a key-weight valve 208. As seen in FIG. 6, the key-weight valve 208, which is in a normally closed position, is mounted on the connection block 205 and is connected to the hose 203. As such, the gas supply 202 does not flow through the key-weight valve 208 unless it is operatively engaged. A conduit or passage 209, which is contained within the connection block 205, interconnects the key-weight valve 208 to a door valve 210. The door valve 210 is mounted to the connection block 205 and is also in a normally closed position. A conduit 211 interconnects the door valve 210 to a splitter valve 212. The splitter valve 212 is contained within the connection block 205 and functions to re-direct the flow of gas from the door valve 210 in two separate directions. In one direction, a conduit 214 interconnects the splitter valve 212 to a clamping mechanism 216 which is mounted on the connection block 205. In another direction, a conduit 217 interconnects the splitter valve 212 to a hose 218 which is connected to the inlet of a low pressure regulator 220 that reduces the pressurized gas supply 202 from about 70 psi to about 0.5 psi. The outlet of the low pressure regulator 220 is connected to the connection block 205 where a conduit 221 transfers the gas to a nozzle 222 which extends outwardly from the connection block 205. The nozzle 222 has a bias cut 223 which facilitates the insertion of a balloon 224 thereon.

A key-weight 226 is inserted into the key-weight receptacle 206 to actuate the device 200. The key-weight 226 has a key-weight ridge 227 that functions to open the normally closed key-weight valve 208. Typically, a ribbon 228 interconnects the key-weight 226 to the balloon 224 as designated by the letter A. It will be appreciated that the key-weight 226 could be provided without a ridge, where the body of the weight operatively engages the key-weight valve 208. Alternatively, the device 200 could be actuated by other appropriate means.

Figure 7:
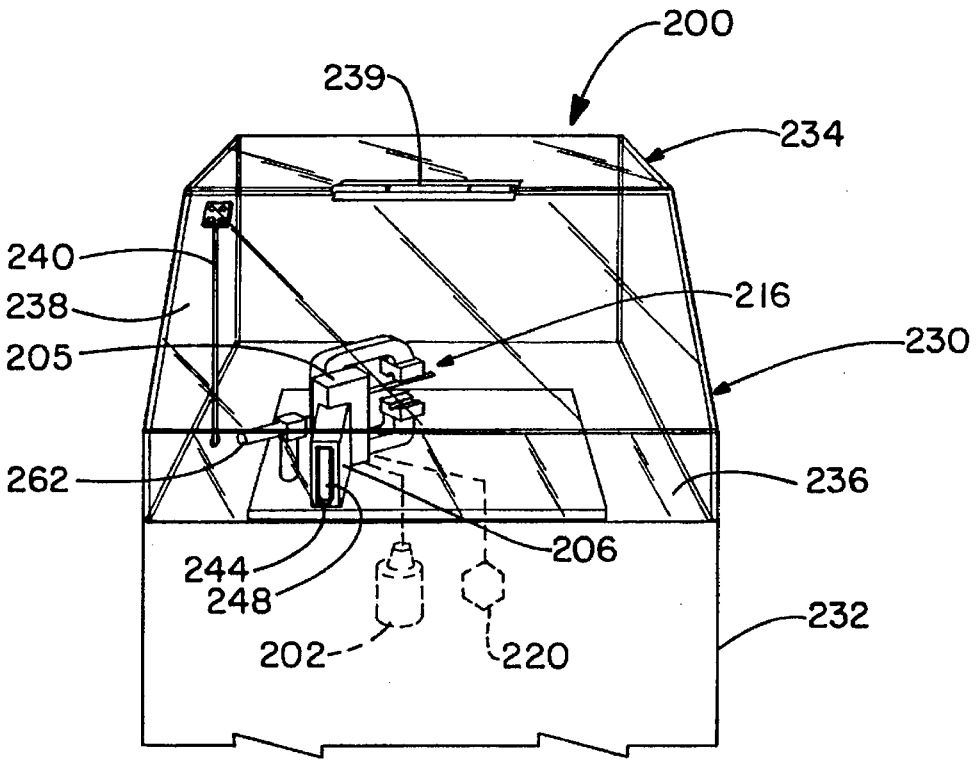
FIG. 7 is a perspective view of a housing which contains the alternative embodiment of the automated balloon inflation device.
Figure 8:
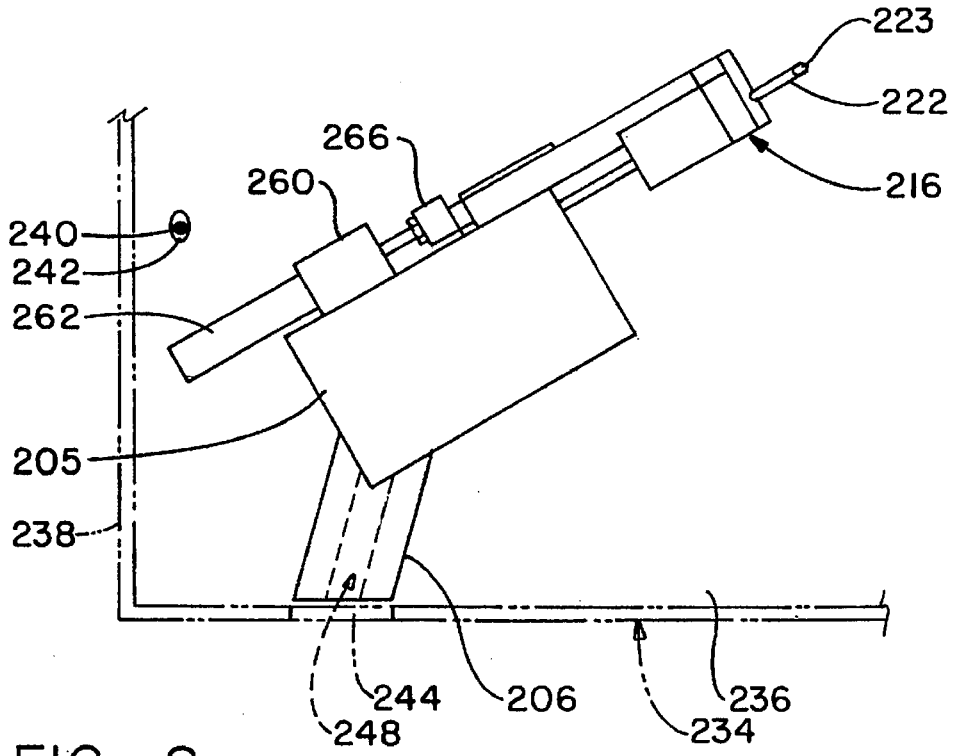
FIG. 8 is a top view of a connection block mounted within the housing.

Referring now to FIGS. 7 and 8, it can be seen that a housing 230 receives the device 200. The housing 230 may include a cabinet portion 232, a hood portion 234 and a counter top 236 which separates the cabinet portion 232 from the hood portion 234. The cabinet portion 232 receives the pressurized gas supply 202 and its attached hose 203, and the low pressure regulator 220 and its attached hose 218. Those skilled in the art will appreciate that the cabinet portion 232 conceals the pressurized gas supply from the general public. The connection block 205 is mounted to the counter top 236 and extends outwardly into the hood portion 234. A door 238 is connected by a hinge 239 to the hood portion 234. As in the previous embodiment, the hood portion 234 and the door 238 are made of an optically dear material such as glass or plastic to allow the consumer to watch as the clamping mechanism 216 is actuated and the balloon 224 is inflated. It will be appreciated that the device 200 could be provided in variations of the components included in the housing 230.

A door rod 240, which operatively actuates the door valve 210, is pivotally connected to the door 238. The door rod 240 passes through the counter top 236 and into the cabinet portion 232 by virtue of a rod opening 242. In the preferred embodiment, the opening 242 is oval shaped to allow lateral movement of the door rod 240 as the door 238 is opened and closed. The hood portion 234 also has a key-weight opening 244 located in from of the key-weight receptacle 206 to allow the passage of the key-weight 226 therethrough. Alternatively, the key-weight receptacle 206 could extend through the key-weight opening 244 to receive the key-weight 226. The door 238 could also provide the key-weight opening 244.

Figure 9:
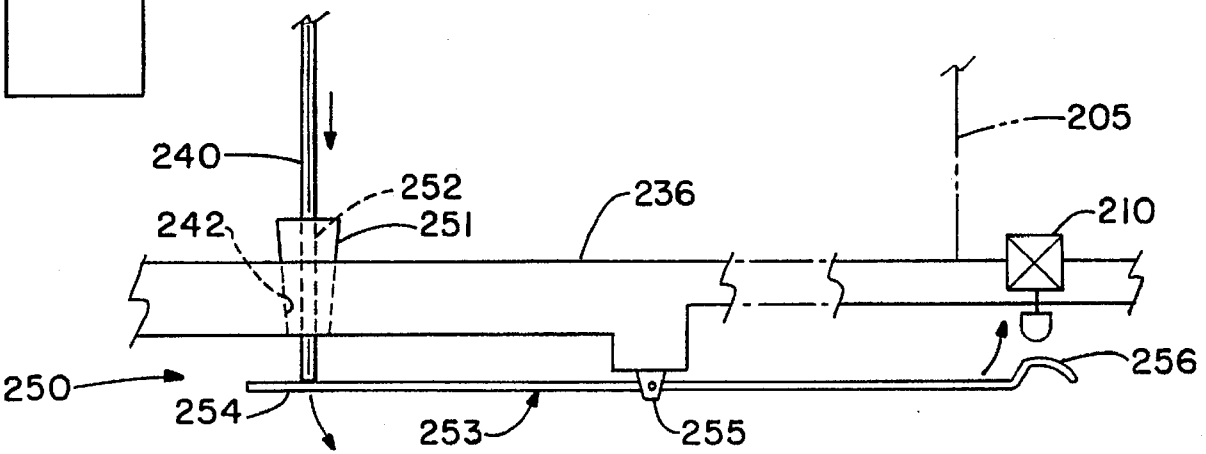
FIG. 9 is a schematic diagram illustrating a door trigger employed in the alternative embodiment.

Referring now to FIG. 9, it can be seen that a door trigger employed in the device 200 is designated generally be the numeral 250. To actuate the door trigger 250, a rod retainer 251 having a retainer hole 252 is received within the rod opening 242. The rod retainer 251 functions to retain the door rod 240 as the door 238 is opened and closed. As the door 238 is closed, the door rod 240 strikes an actuation bar 253, and in particular a rod end 254. The actuation bar 253 has a pivot point 255 that is either secured to the inside of the cabinet portion 232 or the underside of the counter top 236. In any event, as the door rod 240 pushes the rod end 253 down, the opposite end of the actuation bar 253, and in particular a valve end 256 moves upwardly with respect to the pivot point 255 and strikes the door valve 210. The valve end 256 extends angularly from the actuation bar 253 to ensure that a maximum force is applied to engage the door valve 210. Of course, other trigger mechanisms could be employed to engage the door valve 210 whenever the door 238 is opened or closed.

Figure 10:
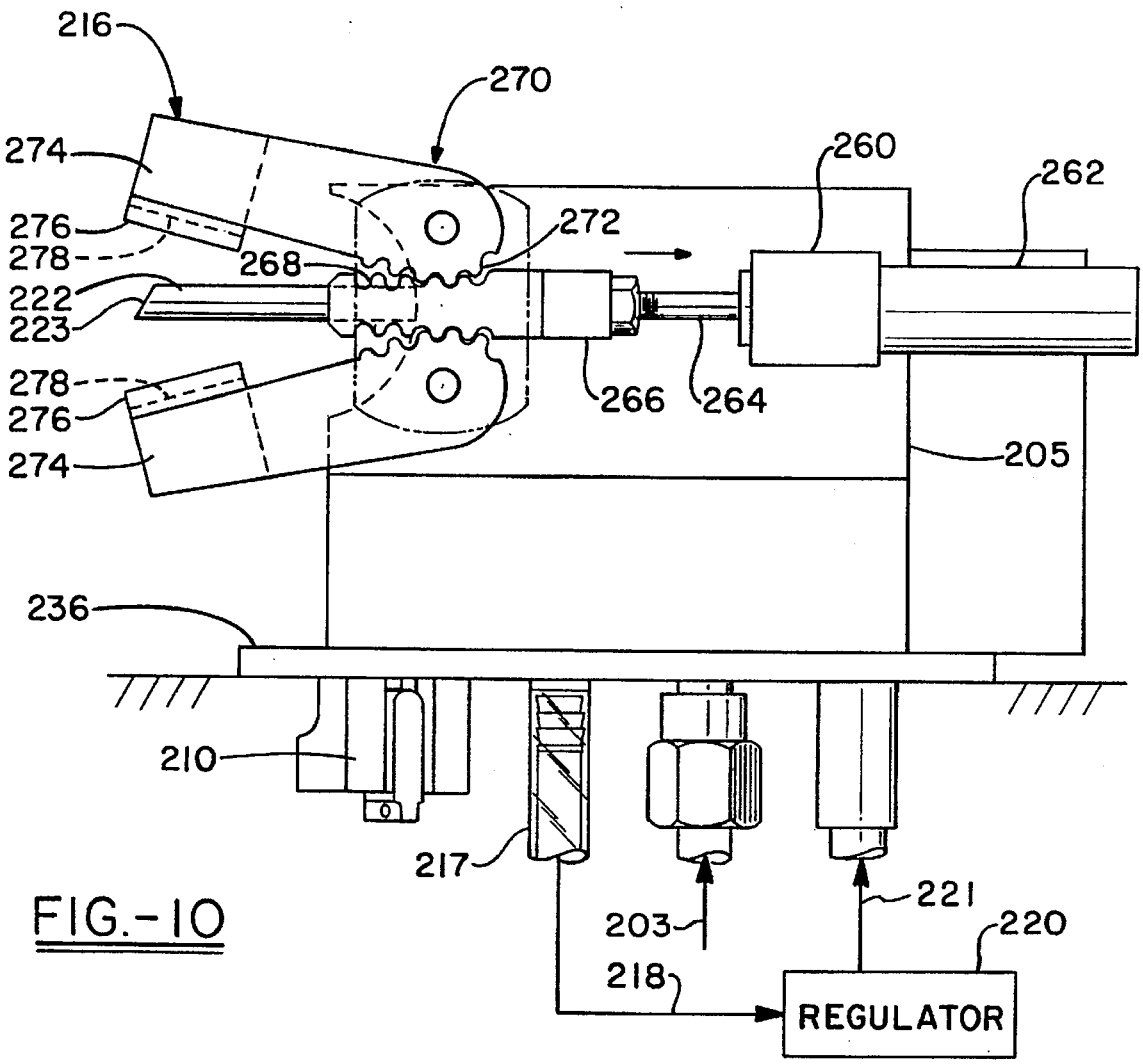
FIG. 10 is an elevational view showing a clamping device in an open position with the components of the device shown in schematic form.
Figure 11:
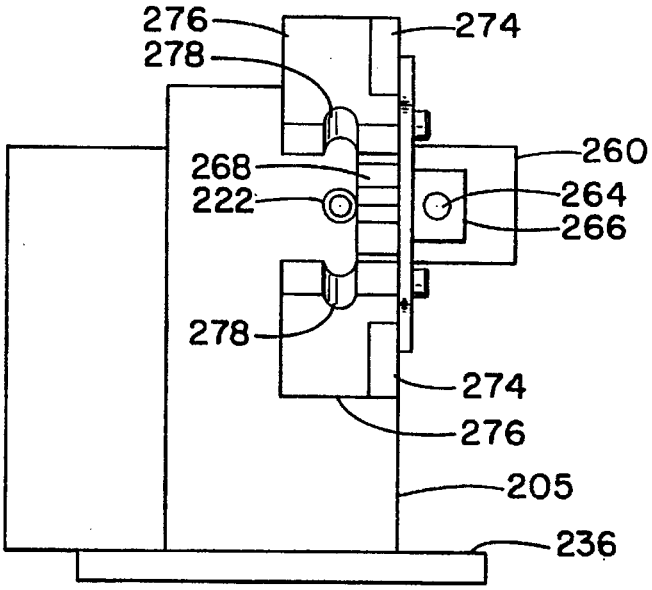
FIG. 11 is an end view showing the clamping device in the open position.

Referring now to FIGS. 10 and 11, the structure of the clamping mechanism 216 is presented. A clamp block 260 is mounted on the connection block 205 and is connected to the conduit 214. A gas cylinder 262 is connected to the conduit 214 and mounted within the clamp block 260. A piston 264, which is slidable within the gas cylinder 262, has an initial extended position and a retracted position, wherein the piston is retracted whenever gas is supplied to the gas cylinder 262. Connected to the piston 264 is a gear 266 which has a plurality of teeth 268 on each side thereof. Pivotally mounted to the connection block 205 are a pair of circularly shaped heads 270. Each head 270 has a plurality of teeth 272 that mesh with the teeth 268. Extending from each head 270 is an arm 274 that has a clamp jaw 276 secured thereto. Each clamp jaw 276 has a channel 278 which fits around the nozzle 222 and a balloon 224 which is received thereon. The clamp jaws 276 are typically made of a polymeric material such as nylon, teflon or any other similar material that does not damage the balloon when the clamp closes on the nozzle 222. When the supply of pressurized gas 202 flows to the gas cylinder 262, the piston 264 is retracted and the teeth 268 mesh with the teeth 272 to rotate the heads 270 inwardly. Accordingly, as the heads 270 rotate inwardly, the clamp jaws 276 apply a compressive sealing force onto the nozzle 222. Those skilled in the art will appreciate that this sealing force is sufficient to hold the balloon 224 onto the nozzle 222 and prevent the balloon form being pushed off of the nozzle during inflation.

In operation, a consumer purchases an uninflated balloon 224 which has attached thereto a key-weight 226 at the opposite end of a ribbon 228. The consumer opens the hinged door 238 and inserts the balloon 224 onto the nozzle 222. At this time, the consumer positions the key-weight 226 and attached ribbon 228 outside of the hood portion 234. The consumer then closes the door 238 which causes the door rod 240 to engage the door trigger 250. As the rod end 254 of the actuation bar 253 is pushed downwardly, the valve end 256 is rotated upwardly to open the normally closed door valve 210. The consumer inserts the key-weight 226 into the key-weight receptacle 206 so that the key-weight ridge 227 opens the normally closed key-weight valve 208. Of course, the key-weight valve 208 could be engaged by a key-weight 226 not having a ridge. At this time the supply of pressurized gas flows through the hose 203, the conduit 209 and the conduit 211. The splitter valve 212 then directs the supply of pressurized gas 202 to both the clamping mechanism 216 and the nozzle 222.

As described previously, the flow of gas proceeds through the conduit 214 to actuate the clamping mechanism 216. Simultaneously, the flow of pressurized gas flows through the conduit 217 into the low pressure regulator 220 which reduces the pressure of the supplied gas to about 0.5 psi and transfers this gas into the nozzle 222. Those skilled in the art will appreciate that the regulator 220 effectively impedes the flow of gas so that the clamping mechanism 216 has sufficient time to clamp the balloon 224 to the nozzle 222 prior to the gas flowing through the nozzle and into the balloon 224. This prevents the balloon from flying off of the nozzle 222 prior to the clamping mechanism 216 closing. When the pressure inside the balloon reaches about 0.5 psi, the balloon 224 is completely inflated and the flow of gas thereto is stopped. The consumer then withdraws the key-weight 226 from the key-weight receptacle 206 to effectively stop the flow of gas to the clamping mechanism 216 and the nozzle 222 which sequentially stops the inflation cycle and forces the clamping mechanism 216 to open. The consumer then opens the door 240 which deactivates the door valve 210 and vents any gas remaining in the connection block 205 to atmosphere. The consumer withdraws the now inflated balloon 224 from the nozzle 222 and the device 200 is ready to receive another balloon for inflation. As in the previous embodiment, the balloon 224 has a self-sealing valve that prevents any gas from escaping as the balloon is taken off the nozzle 222.

It is apparent then from the above-description of the operation and structure of the automated balloon inflation device 200 that the advantages of the first embodiment are retained. Additionally, the present embodiment of the device 200 presents a more compact structure that is easier to manufacture, is more reliable and is easier to service. Moreover, the device 200 provides an added safety feature in that the device is only operable when the door is closed and the key-weight 226 or 260 is inserted into the key-weight receptacle 206. Moreover, the inflation cycle is interrupted whenever the door 240 is inadvertently opened. This functions to release any of the gas within the connection block 205 and opens the clamping mechanism 216. The device 200 also has the added safety feature of denying direct access to the helium by the general public.

Thus, it can be seen that the objects of the invention have been satisfied by the structure presented above. It should be apparent to those skilled in the art that the objects of the present invention could be practiced with any type of balloon or adapted to perform with any type of pressurized gas.

While the preferred embodiment of the invention has been presented and described in detail, it will be understood that the invention is not limited thereto or thereby. Especially in that various materials and configurations may be used in the construction of the invention to meet the various need of the consumer. Accordingly, for an appreciation of the true scope and breadth of the invention, reference should be made to the following claims.

What is claimed is:

1. An automated balloon inflation device for inflating balloons, comprising:

a supply of pressurized gas;

a nozzle for receiving a balloon;

means for clamping around the balloon and said nozzle; and a connection block having a plurality of conduits therethrough for transferring said supply of pressurized gas to actuate said clamping means and to said nozzle for inflating the balloon.

2. The device according to claim 1, further comprising:

a key-weight valve mounted to said connection block; and a door valve mounted to said connection block;

wherein said key-weight valve and said door valve are operatively engaged to allow said supply of pressurized gas to flow through said connection block.

3. The device according to claim 2, further comprising:

a housing which has a cabinet portion and a hood portion separated by a counter top;

wherein said supply of pressurized gas is received within said cabinet portion and wherein said connection block is mounted to said counter top and extends into said hood portion.

4. The device according to claim 3, further comprising:

a pressure regulator connected to said connection block and received within said cabinet portion and disposed between said nozzle and said supply of pressurized gas, said pressure regulator transferring said supply of pressurized gas to said nozzle to inflate the balloon until a pre-determined pressure is attained within the balloon.

5. The device according to claim 4, wherein said hood portion has a door hingedly connected thereto and a key-weight opening;

said key-weight opening receiving a retrievable key-weight that operatively engages said key-weight valve and said door operatively engaging said door valve when in a closed position.

6. The device according to claim 5, wherein said clamping means comprises:

a gas cylinder mounted to said connection block and having a piston therein;

a gear connected to said piston; and a pair of clamping jaws meshing with said gear, said gear moving said clamping jaws to close upon said nozzle when said supply of pressurized gas is transferred to said gas cylinder.

7. The device according to claim 5, further comprising:

a door rod connected to said door; and an actuation bar received within said cabinet portion, said actuation bar having a rod end opposite a valve end;

said door rod striking said door end causing said valve end to engage said door valve and allowing said supply of pressurized gas to flow through said connection block.

8. The device according to claim 1, further comprising:

a retrievable key-weight; and a key-weight valve mounted to said connection block and actuated by said retrievable key-weight to allow said supply of pressurized gas to flow through said connection block.

9. An automated balloon inflation device for inflating balloons, comprising:

a connection block which has a plurality of conduits therethrough;

a key-weight valve connected to one of said plurality of conduits;

a door valve connected to one of said plurality of conduits;

a nozzle connected to one of said plurality of conduits;

a clamping mechanism connected to one of said plurality of conduits, said clamping mechanism closable upon a balloon received by said nozzle; and a supply of gas connected to one of said plurality of conduits, said supply of gas actuating said clamping mechanism and inflating the balloon when said key-weight valve and said door valve are operatively engaged, said supply of gas flowing through said plurality of conduits.

10. The device according to claim 9, further comprising:

a pressure regulator connected to said connection block, said pressure regulator transferring said supply of gas to said nozzle to inflate the balloon until a predetermined pressure is attained within the balloon.

11. The device according to claim 10, further comprising:

a splitter valve received within said connection block to direct said supply of gas to said clamping mechanism and to said nozzle.

12. The device according to claim 11 wherein said supply of gas is transferred through said plurality of conduits from said key-weight valve to said door valve to said splitter valve, and wherein said splitter valve transfers said supply of gas to said clamping mechanism for closure thereof, said splitter valve also transferring said supply of gas to said pressure regulator.

13. The device according to claim 12, further comprising:

a housing in which said connection block is mounted; and a door hingedly mounted to said housing, wherein said key-weight valve is engaged by a key-weight to allow said supply of gas to enter said connection block and wherein said door valve is engaged by said door to allow said supply of gas to flow to said splitter valve.

14. An automated balloon inflation device for inflating balloons, comprising:

a housing having a cabinet portion and a hood portion separated by a counter top, said hood portion having a key-weight opening;

a door hingedly connected to said hood portion;

a connection block mounted to said counter top, said connection block having a plurality of conduits therethrough;

a supply of gas received within said cabinet portion and connected to one of said plurality of conduits;

a clamping mechanism mounted to said connection block and connected to one of said plurality of conduits;

a nozzle extending from said connection block and connected to one of said plurality of conduits;

a key-weight receptacle connected to said connection block and having a key-weight valve, said key-weight receptacle aligned with said key-weight opening;

a door trigger carried in said cabinet portion;

a door valve mounted to said connection block and operatively engaged by said door trigger; and a door rod mounted to said door and passing through said counter top and engaging said door trigger when said door is in a closed position;

said key-weight receptacle receiving a key-weight to operatively engage said key-weight valve to allow said supply of gas to flow via said plurality of conduits through said key-weight valve, said door valve, said clamping mechanism to secure a balloon to said nozzle, and to said nozzle to inflate the balloon.

15. The device according to claim 14, further comprising:

a pressure regulator connected to said connection block, said pressure regulator transferring said supply of gas to said nozzle to inflate the balloon until a predetermined pressure is attained within the balloon.

16. The device according to claim 15, wherein said clamping mechanism secures the balloon to said nozzle prior to said supply of gas inflating the balloon through said nozzle, and only when said door is closed and said key-weigh is received within said key-weight receptacle.

17. The device according to claim 16, wherein said clamping mechanism comprises:

a gas cylinder mounted to said connection block and having a piston therein;

a gear connected to said piston; and a pair of clamping jaws operatively meshing with said gear, said gear moving said clamping jaws to close upon said nozzle when said supply of pressurized gas is transferred to said gas cylinder.

* * * * *